US008260182B2

(12) United States Patent
Taoka

(10) Patent No.: US 8,260,182 B2
(45) Date of Patent: Sep. 4, 2012

(54) BELT DRIVING DEVICE AND IMAGE FORMING APPARATUS EQUIPPED WITH THE SAME

(75) Inventor: Keitaro Taoka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 12/858,302

(22) Filed: Aug. 17, 2010

(65) Prior Publication Data

US 2011/0052276 A1 Mar. 3, 2011

(30) Foreign Application Priority Data

Aug. 26, 2009 (JP) ..... 2009-195700

(51) Int. Cl.
*G03G 15/01* (2006.01)

(52) U.S. Cl. ..... 399/302; 399/165

(58) Field of Classification Search ..... 399/162, 399/165, 302, 303, 308, 395
See application file for complete search history.

(56) References Cited

U.S. PATENT DOCUMENTS

| | | | | |
|---|---|---|---|---|
| 5,659,851 | A | 8/1997 | Moe | |
| 6,134,406 | A * | 10/2000 | Moe et al. | 399/165 |
| 6,181,900 | B1 * | 1/2001 | Lee et al. | 399/165 |

FOREIGN PATENT DOCUMENTS

| | | |
|---|---|---|
| EP | 859728 | 8/1998 |
| JP | 9-169449 | 6/1997 |
| JP | 2001-146335 | 5/2001 |
| JP | 2001-520611 | 10/2001 |

* cited by examiner

*Primary Examiner* — Hoang Ngo
(74) *Attorney, Agent, or Firm* — Canon USA Inc IP Division

(57) ABSTRACT

In a belt driving device, the width of a belt member is larger than the width of a driven roller portion in the rotation axis direction of the driven roller portion. The belt driving device includes a movement unit configured to, when a load is generated in friction members at both ends of the driven roller portion, rotate and move the friction members in a direction opposite to the moving direction of the belt member.

12 Claims, 15 Drawing Sheets

BELT DRIVING DEVICE AND IMAGE FORMING APPARATUS EQUIPPED WITH THE SAME

BACKGROUND OF THE INVENTION

1. Field of the Invention

The present invention relates to a belt driving device conveying a belt member related to image formation. More specifically, the present invention relates to belt units driving belt members such as an intermediate transfer belt, a transfer belt, and a photosensitive member belt, and an image forming apparatus equipped with the belt unit, such as a copying machine, a printer, or a printing apparatus. Further, the present invention is also applicable to a recording material conveying belt, and a fixing belt of a fixing device.

2. Description of the Related Art

In recent years, as a result of an increase in the processing speed of image forming apparatuses, a configuration has become mainstream in which a plurality of image forming units are arranged side by side with respect to a belt member to perform image forming processes in different colors in parallel. A typical example of such a belt member is an intermediate transfer belt in an electrophotographic full-color image forming apparatus. Toner images of different colors are successively transferred to and superimposed one upon the other on the belt surface, and the color toner images are collectively transferred onto a recording material. This intermediate transfer belt is suspended under tension between a plurality of suspension members, i.e., suspension rollers including a driving roller, and is capable of rotating. As is generally known in the art, such a belt member suspended under tension between a plurality of suspension rollers has a problem in that, during its running, the belt member may deviate toward either end of the rollers depending on the outer diameter precision of the rollers, the alignment precision between the rollers, etc.

As a solution to the problem of such deviation of the belt of a general nature, Japanese Patent Application Laid-Open No. 9-169449 discusses steering roller control using an actuator. Also, there is known a configuration as discussed in Japanese Patent Application Laid-Open No. 2001-146335, in which a belt deviation restriction member is provided.

However, the steering roller control as discussed in Japanese Patent Application Laid-Open No. 9-169449 requires a rather complicated control algorithm, and, further, it involves a rather high cost due to electrical components such as sensors and actuators. The configuration discussed in Japanese Patent Application Laid-Open No. 2001-146335 requires no sensors or actuators. However, there is a limitation to an increase in the processing speed of the image forming apparatus since the restriction member is constantly under the deviation force of the belt member during conveyance. Further, this configuration involves a high inspection/management cost in relation to the attachment precision of the restriction member.

In view of this, Published Japanese Translation of PCT Application No. 2001-520611 discusses a simple and inexpensive belt deviation control method in which a steering roller serving as a steering member automatically performs belt alignment through frictional force balancing (hereinafter referred to as the automatic belt alignment). The system as discussed in Published Japanese Translation of PCT Application No. 2001-520611 is equipped with a steering mechanism. More specifically, a steering roller composed of a central roller portion capable of following the rotation of the belt member and end members incapable of following the rotation of the belt member, is supported on a support stand rotatable with respect Co a steering shaft provided at the central portion. Here, the support stand is urged by a tension imparting portion compressed by a pressurization releasing cam, with the result that the outer peripheral surface of the steering roller imparts tension to the inner peripheral surface of the belt member.

The principle of the automatic belt steering will be described with reference to FIGS. 15A and 15B. As already described, end members 91 are supported so as to be incapable of following the rotation of the belt, so that they constantly receive frictional resistance from the inner peripheral surface of the belt member during belt conveyance.

FIG. 15A illustrates how a belt member 50, which is driven and conveyed in the direction of the arrow V, is wrapped around the end members 91 at a wrapping angle $\theta_s$. As for the width (the direction perpendicular to the plane of the drawing), it is to be regarded as a unit width. A belt length corresponding to a minute wrapping angle component $d\theta$ of a certain wrapping angle $\theta$ will be considered; on the upstream side, i.e., the loose side, there is tangentially exerted a tensile force T, and, on the downstream side, i.e., on the tension side, there is tangentially exerted a tensile force T+dT. Thus, in a minute belt length, assuming that the force the belts exerts in the centripetal direction of the end members 91 is approximated as $Td\theta$, and that the end members 91 have a coefficient of friction $\mu_s$, the frictional force dF is expressed by the following equation:

$$dF=\mu_s Td\theta \tag{1}$$

Here, the tension T is controlled by a driving roller (not shown), and, assuming that the driving roller has a coefficient of friction $\mu_r$, the following equation holds true:

$$dT=\mu_r Td\theta \tag{2}$$

That is, $$\frac{dT}{T} = -\mu, d\theta \tag{2'}$$

When equation (2') is integrated with respect to the wrapping angle $\theta_s$, the tension T is obtained as follows:

$$T=T_1 e^{-\mu_r\theta} \tag{3}$$

where $T_1$ is the tension when $\theta=0$.

From equations (1) and (3), the following equation is obtained:

$$dF=\mu_s T_1 e^{-\mu_r\theta} d\theta \tag{4}$$

As illustrated in FIG. 15A, when the end members 91 move in the direction indicated by the arrows S, the wrapping start position ($\theta=0$) has a deflection angle $\alpha$ with respect to the rotating direction. Thus, the downward component in the direction S of the force indicated by equation (4) is expressed as follows:

$$dF_s=\mu_s T_1 e^{-\mu_r\theta} \sin(\theta+\alpha) d\theta \tag{5}$$

$$F_s = \mu_s T_1 \int_0^{\theta_s} e^{-\mu_r\theta} \sin(\theta + \alpha) d\theta \tag{6}$$

In this way, the downward force in the direction of the arrow S that the end members 91 receive during belt conveyance (per unit width) is obtained.

FIG. 15B corresponds to a plan view of FIG. 15A as seen from the direction of the arrow TV. Suppose belt deviation occurs leftward when the belt member 50 is conveyed in the direction of the arrow V as illustrated in FIG. 15B. At this time, as illustrated in FIG. 15B, only the left-hand side portion has an overlapping width w between the belt member 50 and the end member 91.

More specifically, the left-hand side end member 91 receives a downward force in the direction S of $F_s w$, and the right-hand side end member 91 receives a downward force in the direction S of zero. It can be explained that this difference in frictional force between the end portions constitutes a motive power generating a moment $F_s wL$ around the steering shaft (In the assumption in FIG. 15B, the left-hand side, i.e., the deviation side, is directed downwards). In the following, the moment around the steering shaft will be referred to as the steering torque.

The direction of the rudder angle of the steering roller 97 generated through the above principle corresponds to the direction in which the deviation of the belt member 50 is restored to normal, so that it is possible to perform automatic steering.

However, in a configuration in which the width of the belt member is larger than the width between the friction portions at both ends, when the belt member deviates to one end side, steering is started by inclining the steering roller. In this process, the following problem is involved.

As a result of the inclination of the steering roller, the belt member, which has deviated to one end side, starts to move toward the other end side. When, as a result of the movement of the belt member, the friction member at the other end starts to be brought into contact with the belt member, due to the twisting of the belt member caused by the inclination of the steering roller, the frictional force between the friction member at the other end side and the belt member is larger than that when the steering roller is not inclined. As a result, the moving force of the belt member is reduced, so that it is impossible to effect smooth deviation adjustment on the belt member.

Such a problem can also arise when the steering roller is inclined in the case in which the belt member is in contact with the friction portions at both ends.

Thus, to further smoothen the movement of the belt member, it is desirable to reduce this resistance force.

SUMMARY OF THE INVENTION

The present invention is directed to a belt driving device which helps to achieve an improvement in terms of stability in the steering operation of an automatic alignment mechanism for a belt member, and an image forming apparatus equipped with the same.

According to an aspect of the present invention, a belt member configured to be rotatable, a suspension unit configured to suspend the belt member, a steering device configured to suspend the belt member and to steer the belt member, the steering device including a rotating portion configured to be driven to rotate as the belt member is rotated, friction portions provided on both outer sides of the rotating portion in a width direction of the belt member and held in sliding contact with the belt member, a support unit configured to support the rotating portion and the friction portions, and a rotation shaft configured to rotatably support the support unit, the support unit being rotated by a force generated through the sliding contact between the belt member and the friction portions, so that the steering device allows the belt member to move in the width direction, and a restriction unit provided in the steering device and configured to restrict rotation of the friction portions in a rotating direction of the belt member and to allow rotation of the friction portions in a direction opposite to the rotating direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An image forming apparatus according to an exemplary embodiment of the present invention will be described.

Figure 2:
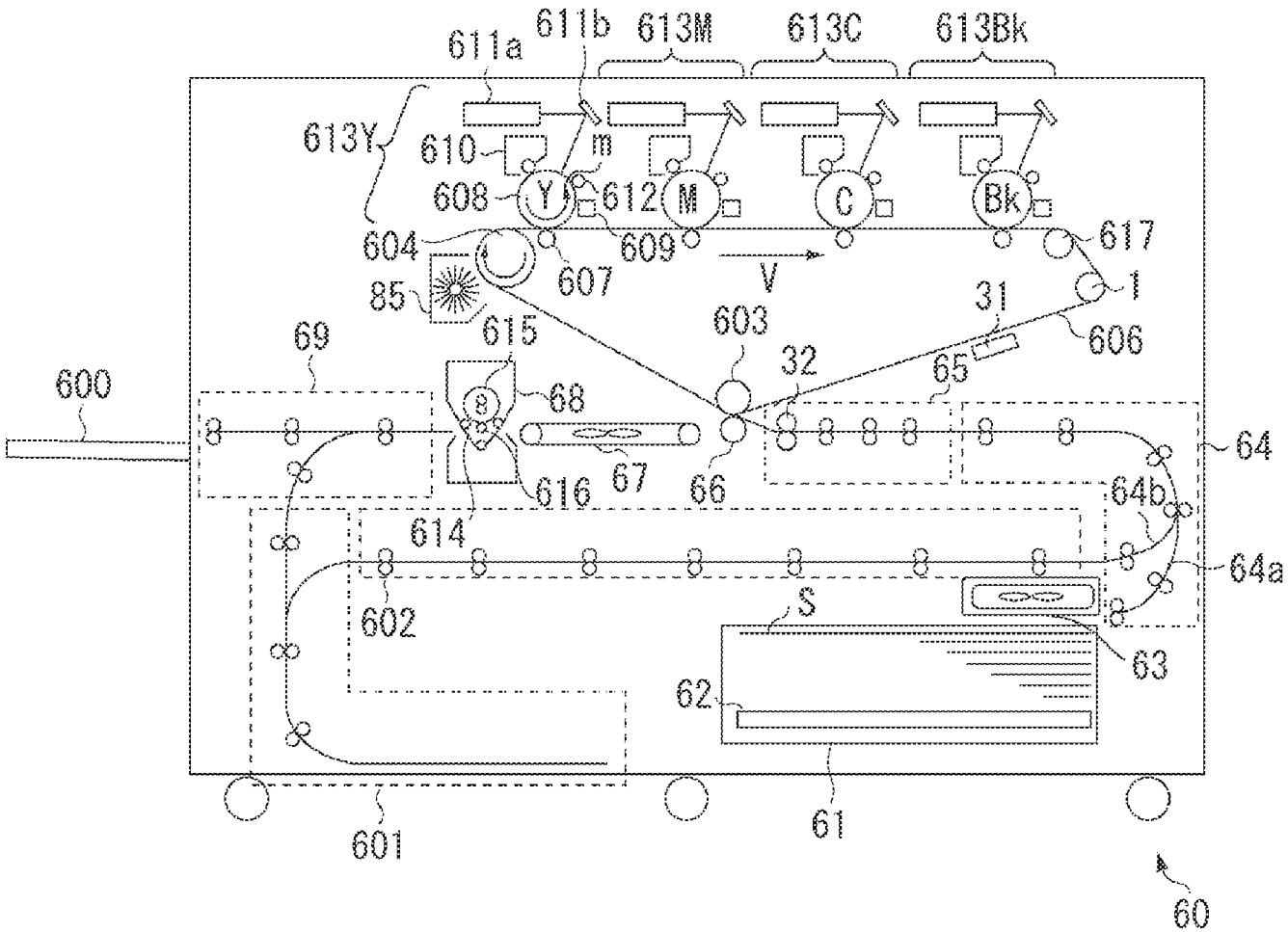
FIG. 2 is a sectional view of an intermediate transfer type image forming apparatus.

First, the operation of the image forming apparatus will be described with reference to FIG. 2. There are a plurality of types of image forming apparatuses, including an electrophotographic type, an offset printing type, and an ink-jet type. FIG. 2 illustrates an image forming apparatus 60, which is a color image forming apparatus using electrophotography. The image forming apparatus 60, illustrated in section, is an intermediate transfer tandem type image forming apparatus in which image forming units of four colors are arranged side by side on an intermediate transfer belt 606. In recent years, this type of image forming apparatus has become mainstream due to its ability to be applied to thick paper and its excellent productivity.

Recording materials S are accommodated in a recording material accommodating portion 61 while stacked up on a lift-up device 62, and are fed by a sheet feeding device 63 in synchronization with image formation. The sheet feeding system adopted in the sheet feeding device illustrated in FIG. 2 is of a type which effects attraction/detachment by air. Of course, it is also possible to adopt some other type of sheet feeding system. A recording material S sent out from the sheet feeding device 63 passes through a transport path 64*a* of a transport unit 64, and is conveyed to a registration device 65. After undergoing skew feed correction and timing correction at the registration device 65, the recording material S is conveyed to a secondary transfer portion. The secondary transfer portion is a transfer nip portion formed by opposing rollers including a secondary transfer inner roller 603, which is a first secondary transfer member, and a secondary transfer outer roller 66, which is a second secondary transfer member. Then, a predetermined pressurizing force and an electrostatic load bias are imparted thereto, so that toner images on the intermediate transfer belt 606 are transferred to the recording material S.

An image forming process, which is conducted until the secondary transfer portion is reached with a timing similar to that of the above-described process of conveying the recording material S up to the secondary transfer portion, will be described.

In the present exemplary embodiment, there are provided an image forming unit 613Y forming an image with yellow (Y) toner, an image forming unit 613M forming an image with magenta (M) toner, an image forming unit 613C forming an image with cyan (C) toner, and an image forming unit 613Bk forming an image with black (Bk) toner. The image forming unit 613Y, the image forming unit 613M, the image forming unit 613C, and the image forming unit 613Bk are of the same configuration except for the colors of the toners, so that the image forming unit 613Y will be described as a representative.

The image forming unit 613Y includes a photosensitive member 608 constituting an image bearing member, a charger 612 charging the photosensitive member 608, an exposure device 611*a*, a developing device 610, a primary transfer device 607, and a photosensitive member cleaner 609. The surface of the photosensitive member 608 rotating in the direction of the arrow m in FIG. 2 is uniformly charged by the charger 612. Based on an input image information signal, the exposure device 611*a* is driven, and the charged photosensitive member 608 is exposed via a diffraction member 611*b*, so that an electrostatic latent image is formed. The electrostatic latent image formed on the photosensitive member 608 is developed by the developing device 610, so that a toner image is formed on the photosensitive member. After this, a predetermined pressurizing force and an electrostatic load bias are applied by the primary transfer member 607, so that a yellow toner image is transferred to the intermediate transfer belt 606, which constitutes the belt member. After this, the residual toner on the photosensitive member 608 is recovered by the photosensitive member cleaner 609, and the image forming unit is made ready for the next image formation.

In the case of FIG. 2 described above, there exist four image forming units 613 for yellow (Y), magenta (M), cyan (C), and black (Bk). Thus, a magenta toner image formed by the image forming unit M is transferred onto the yellow toner image on the intermediate transfer belt 606. Further, a cyan toner image formed by the image forming unit C is transferred onto the formed magenta toner image on the intermediate transfer belt 606. Further, a black toner image formed by the image forming unit Bk is transferred onto the cyan toner image on the intermediate transfer belt 606. In this way, toner images of different colors are superimposed one upon the other on the intermediate transfer belt 606, so that a full-color image is formed on the intermediate transfer belt 606 through superimposition one upon the other of toner images of different colors on the intermediate transfer belt 606. Although the present exemplary embodiment employs four colors, the number of colors in not restricted to four; nor is the arrangement order of colors restricted to that of the present exemplary embodiment.

Next, the intermediate transfer belt 606 will be described. The intermediate transfer belt 606 is suspended by a driving roller 604 constituting a driving member, a steering roller 1 constituting a steering member, a suspension roller 617 constituting a suspension member, and the secondary transfer inner roller 603 constituting a secondary transfer inner member (suspension member). The intermediate transfer belt 606 is a belt member conveyed and driven in the direction of the arrow V in FIG. 2.

The steering roller 1 has also a tension roller function to impart a predetermined tension to the intermediate transfer belt 606. The timing of the image forming processes in the different colors performed in parallel by the image forming units 613Y, 613M, 613C, and 613Bk is such that a toner image is superimposed on another toner image of an upstream color that has undergone the primary transfer. As a result, a full-color toner image is finally formed on the intermediate transfer belt 606, and is conveyed to the secondary transfer portion. The number of rollers suspending the intermediate transfer belt 606 is not restricted to that of the configuration in FIG. 2.

Through the process of conveying the recording material S and the image forming process described above, the full-color toner image formed on the intermediate transfer belt 606 is secondary-transferred onto the recording material S. After this, the recording material S is conveyed to a fixing device 68 by a pre-fixing conveying unit 67. Various configurations and systems are available for the fixing device 68. In the example illustrated in FIG. 2, a predetermined pressurizing force and a predetermined amount of heat are imparted within a fixing nip formed by a fixing roller 615 and a pressurization belt 614 opposed to each other, so that the toner image is melted and caused to adhere to the recording material S. Here, the fixing roller 615 contains a heater serving as a heat source, and the pressurization belt 614 is equipped with a plurality of suspension rollers and a pressurization pad 616 urged by the inner peripheral surface of the belt. The recording material S having passed the fixing device 68 is selectively conveyed by a branching transport device 69. More specifically, it is either discharged onto a discharge tray 600 as it is, or, if two-sided image formation is required, is conveyed to a reverse transport device 601. When two-sided image formation is required, the recording material S conveyed to the reverse transport device 601 undergoes leading/trailing end reversal through switch back operation, and is conveyed to a two-sided transport device 602. After this, in synchronization with the next recording material conveyed from the sheet feeding device 61, joining of the recording materials is effected in a re-feed path 64*b* of the transport unit 64, and the next recording material is also conveyed to the secondary transfer portion. The image forming process on the back surface (second surface) is similar to that on the front surface (first surface), so a description thereof will be omitted.

Figure 3A:
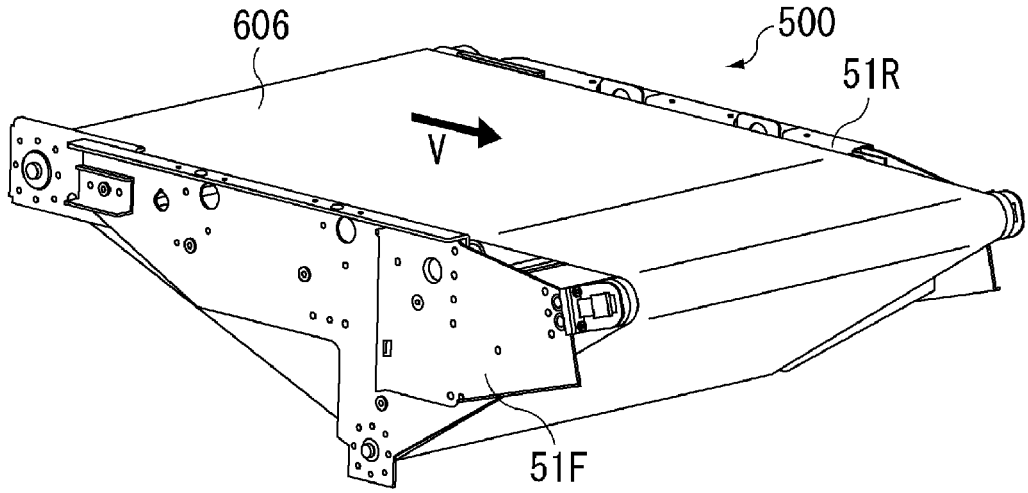
FIGS. 3A and 3B are perspective views of an intermediate transfer belt unit according to a first exemplary embodiment of the present invention.
Figure 3B:
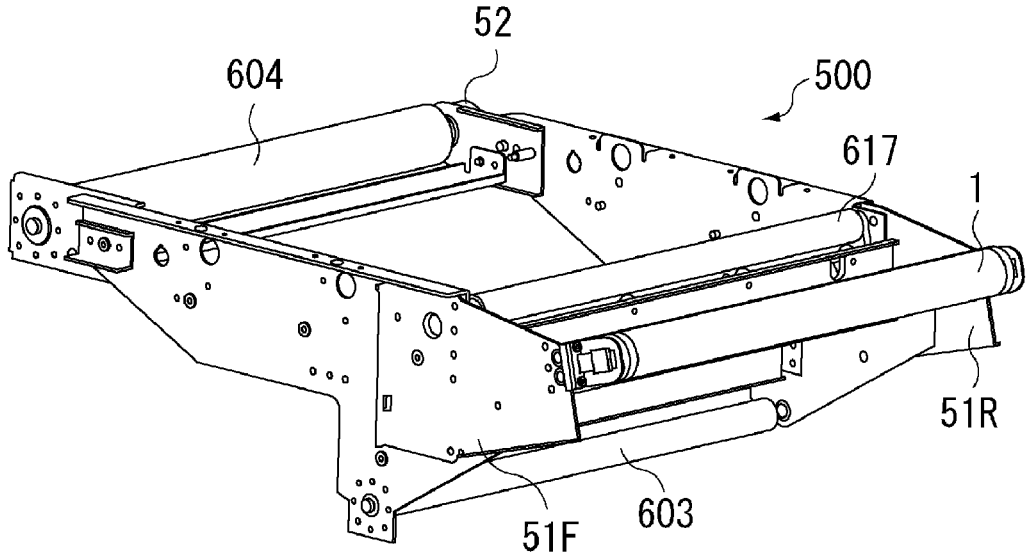

FIGS. 3A and 3B are perspective views of an intermediate transfer belt unit 500 of the image forming apparatus 60 illustrated in FIG. 2. FIG. 3A illustrates a state in which the intermediate transfer belt 606 is suspended, and FIG. 3B illustrates a state in which the intermediate transfer belt 606 is removed. The intermediate transfer belt 606 is conveyed in the direction of the arrow V by the conveying force of the driving roller 604, which is a driving member to which a driving force is input from a driving gear 52 serving as a drive transmission member. In the present exemplary embodiment, there is provided an automatic belt steering mechanism in which the steering roller 1, which is a steering member, utilizes frictional force balance.

Figure 1:
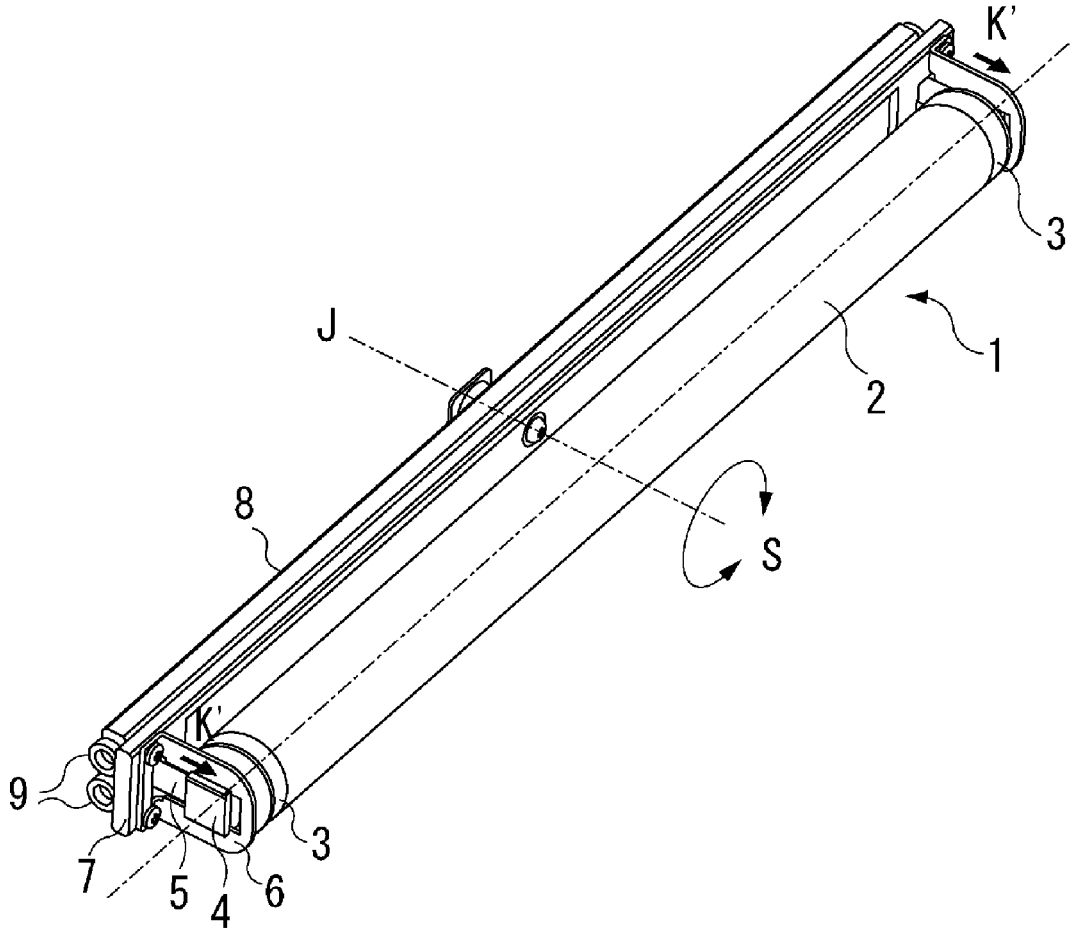
FIG. 1 is a perspective view of an automatic steering mechanism unit according to an exemplary embodiment of the present invention.

FIG. 1 is a partial perspective view of an automatic belt steering mechanism unit according to the present exemplary embodiment. The steering roller 1 includes a driven roller portion 2, which is a rotating portion constituting a central portion, and sliding ring portions 3 provided at both ends thereof and constituting friction portions coaxially connected to the driven roller portion 2. In the present exemplary embodiment, the driven roller portion 2 is held in contact with the intermediate transfer belt 606, and is adapted to follow the rotation of the intermediate transfer belt 606. It can be rotated in the rotating direction of the intermediate transfer belt 606 and in a direction opposite thereto. On the other hand, in the present exemplary embodiment, the sliding ring portions 3 are maintained in a non-rotating state. When the intermediate transfer belt 606 contacts the sliding ring portions 3, steering is effected by a frictional force generated therebetween. Both end portions of the steering roller 1 are supported by slide bearings 4. The slide bearings 4, the slide groove portions (not shown) of which are fit-engaged with side support members 6, are urged so as to slide in the direction of the arrows K' by tension springs (compression springs) 5 which are elastic members. Thus, the steering roller 1 also functions as a tension roller imparting a tension in the direction of the arrows K' to the inner peripheral surface of the intermediate transfer belt 606. Further, together with a rotary plate 7, the side support members 6 constitute a support stand supporting the driven roller portion 2 and the sliding ring portions 3. They are supported so as to be rotatable in the directions of the arrows S with respect to a central steering axis J. As a result, the driven roller portion 2 follows the rotation of the intermediate transfer belt 606, and is rotatable in the directions S around the axis J. A frame stay 8 is a member constituting a casing of the intermediate transfer belt unit 500. It extends between a unit front side plate 51F and a unit rear side plate 51R. At both end side surface portions thereof, the frame stay 8 is equipped with slide rollers 9, serving to reduce the rotational resistance of the rotary plate 7.

Figure 4:
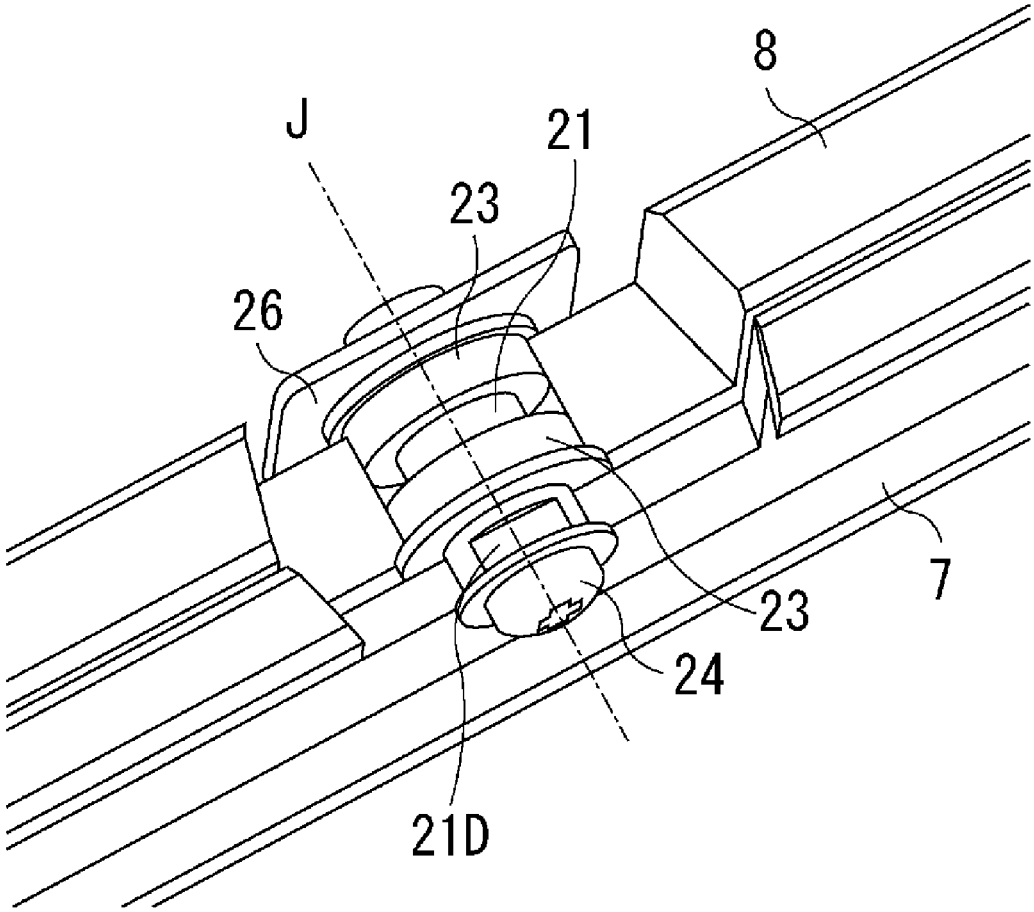
FIG. 4 is a perspective view illustrating a rotation center of the automatic steering mechanism unit.

Next, the configuration of the automatic belt steering mechanism will be described in more detail with reference to FIGS. 4, 5A, and 5B. FIG. 4 is a sectional view illustrating the configuration of a rotation center portion of the support stand. A steering shaft 21, one end portion of which is of a two-way-cut configuration 21D, is fit-engaged with the central portion of the rotary plate 7, and is integrally fastened thereto by a screw 24. The other end portion of the steering shaft 21 is inserted into a bearing 23 retained by the frame stay 8, and then a thrust detachment prevention member 26 is mounted thereto.

Figure 5A:
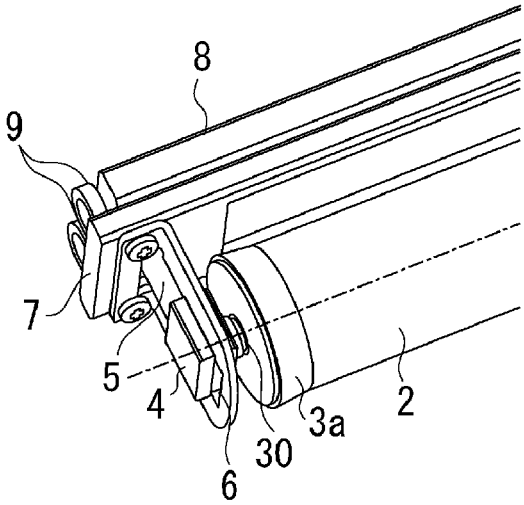
FIGS. 5A and 5B are perspective views illustrating an end portion of the automatic steering mechanism unit.
Figure 5B:
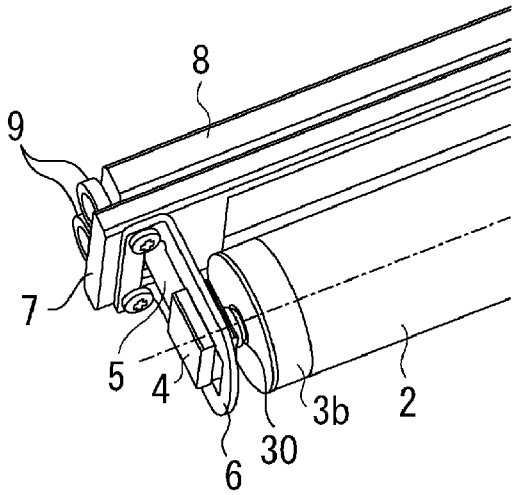

FIG. 5A illustrates in detail one end portion of the automatic belt steering mechanism unit.

A sliding ring portion 3*a*, which is a friction portion, is of a tapered configuration that is continuously increased in diameter toward the outer side of the roller axis direction (the rotation axis direction of the driven roller 2). The outer diameter of the portion of the tapered portion adjacent to the driven roller portion 2 is equal to the outer diameter of the driven roller portion 2. As it extends outwards, its outer diameter becomes gradually larger than the outer diameter of the driven roller portion 2. In the present exemplary embodiment, the configuration of the above portion is not restricted to a tapered configuration. Any configuration may be employed so long as it has an inclined portion in which, as the region held in contact with the belt member extends outwards in the roller axis direction, the distance between the rotation axis and the outer surface of the friction portion increases.

Figure 6A:
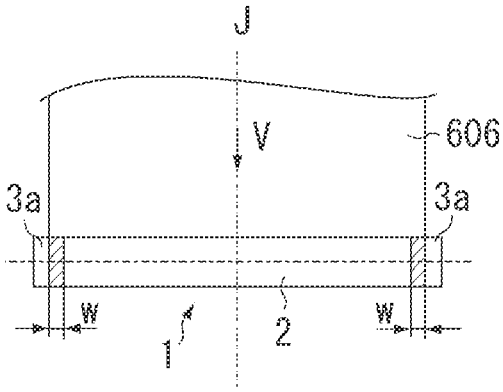
FIGS. 6A and 6B illustrate an overlapping width relationship between a belt and sliding ring portions.
Figure 6B:
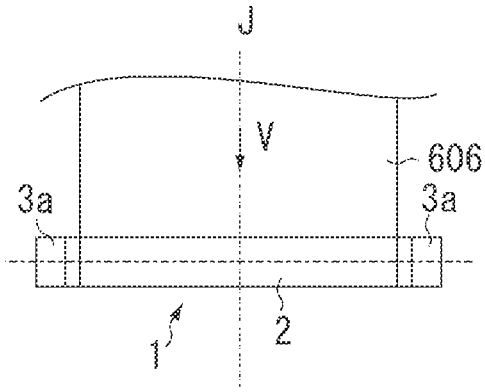

In the present exemplary embodiment, the width of the intermediate transfer belt 606 is larger than the width of the driven roller portion 2 and smaller than the width of the steering roller 1 (the driven roller portion 2 plus the sliding ring portions 3*a* at both ends). More specifically, in the state in which the steering roller 1 is not inclined in the direction S, the overlapping width relationship between the intermediate transfer belt 606 and the sliding ring portions 3*a* is such that the two end portions exhibit an equal overlapping width (indicated by the shaded portions) as illustrated in FIG. 6A. The overlapping width is the width by which both end portions of the intermediate transfer belt 606 slide on the sliding ring portions 3. In the case of this relationship, the intermediate transfer belt 606 always slides while exhibiting an overlapping width with respect to one of the sliding ring portions 3*a*, so that it is possible to finely perform steering operation with respect to a belt deviation generated. Conversely, in the case in which, as illustrated in FIG. 6B, the width of the intermediate transfer belt 606 is smaller than the width of the driven roller portion 2, if a belt deviation is generated, the support stand does not rotate until the sliding ring portions 3*a* exhibit an overlapping width, so that an abrupt steering operation is likely to result. In this way, from the principle point of view, automatic belt steering utilizing frictional force balance is possible even in the case of the overlapping width relationship as illustrated in FIG. 6B. However, the overlapping width as illustrated in FIG. 6A, which always allows detection of a difference in balance, is superior in that it helps to suppress changes with passage of time in the rudder angle. More specifically, it is naturally advantageous with respect to a main scanning positional deviation. Further, also when the automatic belt steering is viewed from the viewpoint of control, it is also advantageous in that it can suppress abrupt steering operation.

Next, the coefficient of static friction $\mu_s$ of the sliding ring portions 3*a* will be described.

More specifically, in the present exemplary embodiment, when the sliding ring portions are of a tapered configuration as illustrated in FIG. 5A, $\mu_s$ is approximately 0.3, and the taper angle $\phi$ is 8 degrees.

The coefficient of friction of the surfaces of the sliding ring portions 3 is larger than the coefficient of friction of the surface of the driven roller portion 2. As the material of the sliding ring portions 3*a*, there is used a resin material such as polyacetal (POM). Further, taking into account the electrostatic problem due to the frictional charging with the intermediate transfer belt 606, conductivity is also imparted to the material. The configuration of the sliding ring portions 3*a* is not restricted to the tapered one. It is also possible to adopt a straight configuration as illustrated in FIG. 5B. In this case, it is desirable for the coefficient of static friction to be set larger than that in the case of the tapered configuration. For example, $\mu_s$ is set to approximately 0.6. The reason for this setting is that, in the case of the tapered configuration, the outer diameter is large, so that the perpendicular resistance force of the intermediate transfer belt 606 with respect to the sliding ring portions 3*a* is large, whereas, in the case of the straight configuration, the perpendicular resistance force is small, so that it is desirable for the coefficient of friction to be larger to generate the same frictional force.

Next, the coefficient of static friction $\mu_{STR}$ of the driven roller portion 2 will be described. As the material of the driven roller portion 2, aluminum is used. The coefficient of friction $\mu_{STR}$ of the surface is approximately 0.1; i.e., it is set smaller than the coefficient of friction $\mu_s$ of the sliding ring portions.

The intermediate transfer belt 606 is formed as a resin belt whose base layer is made of polyimide, and its tensile modulus E is approximately 18000 N/cm$^2$. In this way, the large tensile stress generated in the material of large tensile modulus E and hard to expand can be effectively converted to a belt returning force by reducing the coefficient of friction $\mu_{STR}$ of the driven roller portion 2.

At the same time, this constantly releases strain generated in the intermediate transfer belt 606, so that there is no fear of the intermediate transfer belt 606 being conveyed while receiving an excessive load.

As a result, not only can automatic belt steering be realized but it is also possible to prevent breakage of the intermediate transfer belt 606, etc. The material of the intermediate transfer belt 606 is not restricted to polyimide. It is also possible to adopt some other resin material or a metal material so long as the belt has a base layer having an equivalent tensile modulus and hard to expand. Similarly, regarding the material of the driven roller portion 2, it is also possible to adopt some other material so long as $\mu_{STR} \leqq \mu_s$.

Here, a method of measuring the coefficients of friction of the sliding ring portions 3, the driven roller portion 2, the driving roller, etc. will be illustrated. In the present exemplary embodiment, there is adopted the plastic-film/sheet coefficient of friction testing method according to JIS K7125. More specifically, the measurement is performed using as a test piece a polyimide sheet constituting the inner peripheral surface of a belt member, which, in the present exemplary embodiment, is a sheet constituting the inner peripheral surface of an intermediate transfer belt.

Figures 7A, 7B:
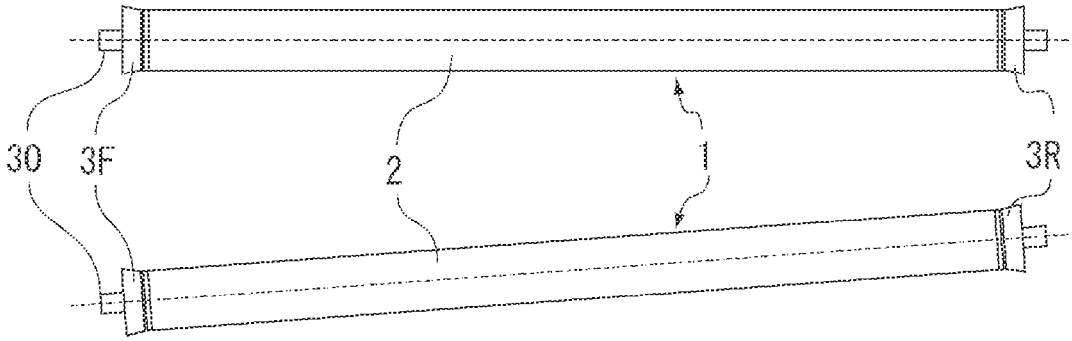
FIGS. 7A and 7B illustrate a steering roller as seen from a direction perpendicular to a steering direction.
Figure 8:
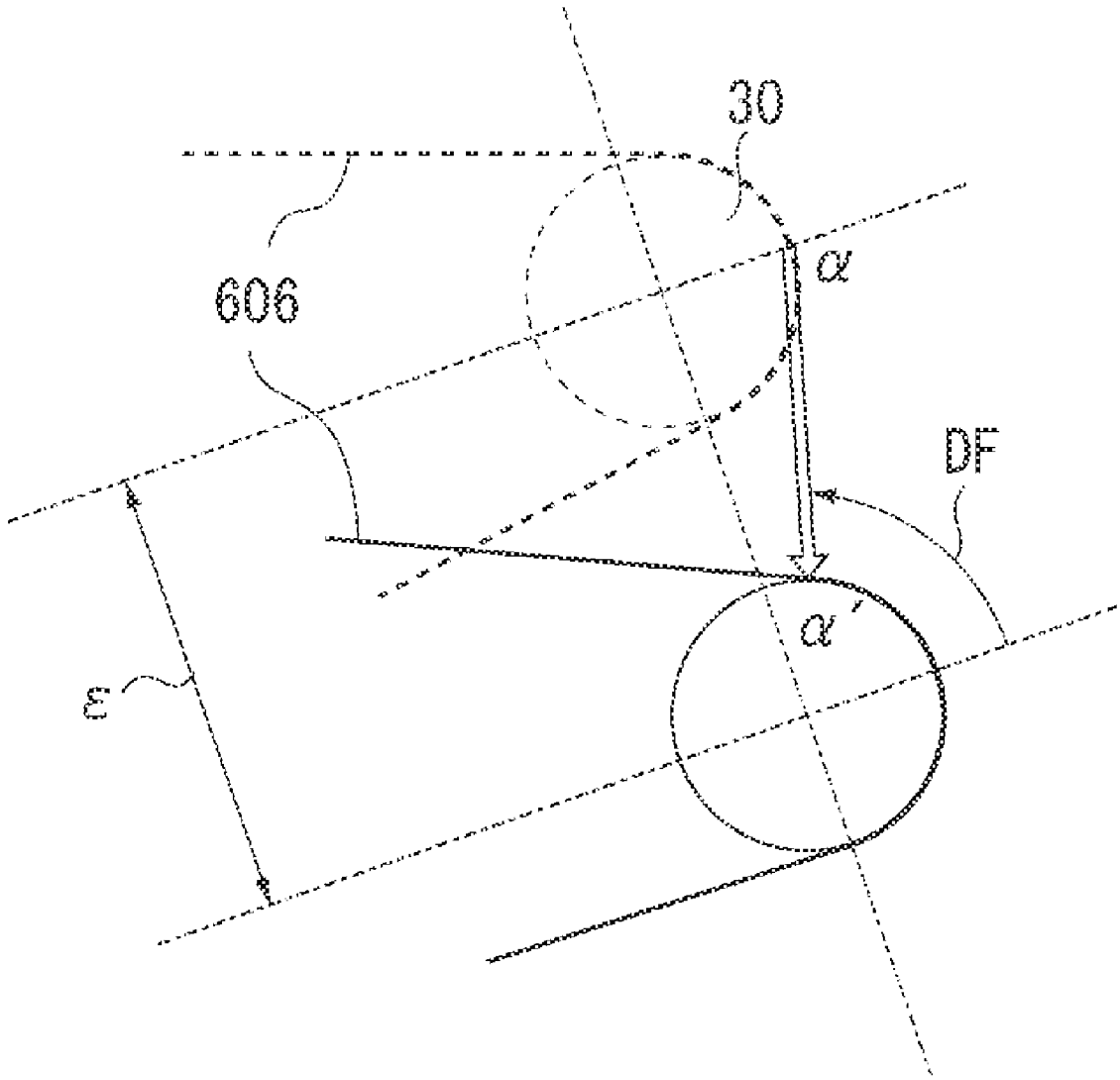
FIG. 8 illustrates the steering roller as seen from the sliding ring portion side.
Figure 15A:
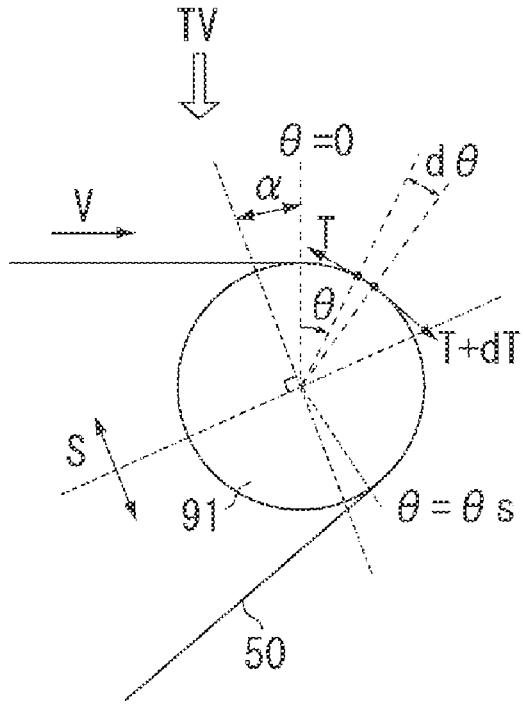
FIGS. 15A and 15B are diagrams illustrating the principle of automatic belt steering.
Figure 15B:
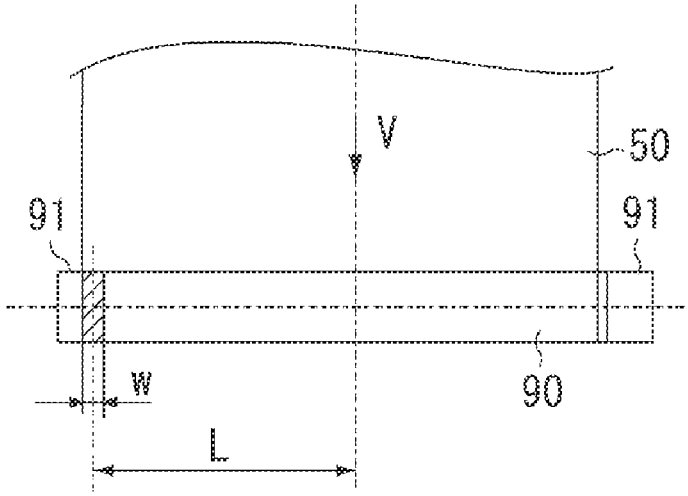

The features and effects of the automatic belt steering will be described. The principle of the automatic steering is similar to that as described with reference to FIGS. 15A and 15B. FIGS. 7A and 7B illustrate the steering roller 1 as seen from the front side plane including the direction S in FIG. 1. Here, the sliding ring portion 3*a* on the left-hand side as seen in FIG. 1 will be referred to as the sliding ring portion 3F, and the sliding ring portion 3*a* on the right-hand side as seen FIG. 1 will be referred to as the sliding ring portion 3R. In FIG. 7A, the intermediate transfer belt (not shown) is in the state in which the steering roller 1 has not been rotated in the direction S. In this case, the steering roller 1 has not been inclined, that is, has not been rotated in the direction S of FIG. 1. FIG. 7B illustrates the state of the steering roller 1 in which the intermediate transfer belt (not shown) deviates to the sliding ring portion 3F side and in which the steering roller 1 has been inclined, that is, has been rotated in the direction S in FIG. 1. FIG. 8 is a diagram illustrating the steering roller 1 as seen from the sliding ring portion 3F side. In FIG. 8, the dashed line indicates the state in FIG. 7A, and the solid line in FIG. 8 indicates the state in FIG. 7B. Due to the fluctuation in the positional relationship between the steering roller 1 and an upstream suspension roller (not shown) as a result of the steering operation, that is, due to the change in the positional relationship between the steering roller 1 and a downstream suspension roller (not shown), the contact surface between the intermediate transfer belt 606 and the sliding ring portion 3F fluctuates. As a result, point $\alpha$ on the sliding ring portion 3F, which has been in contact with the intermediate transfer belt 606, is shifted to point $\alpha'$, and a change in position occurs in the peripheral direction of the sliding ring portion by an amount $D_F$.

Figure 9:
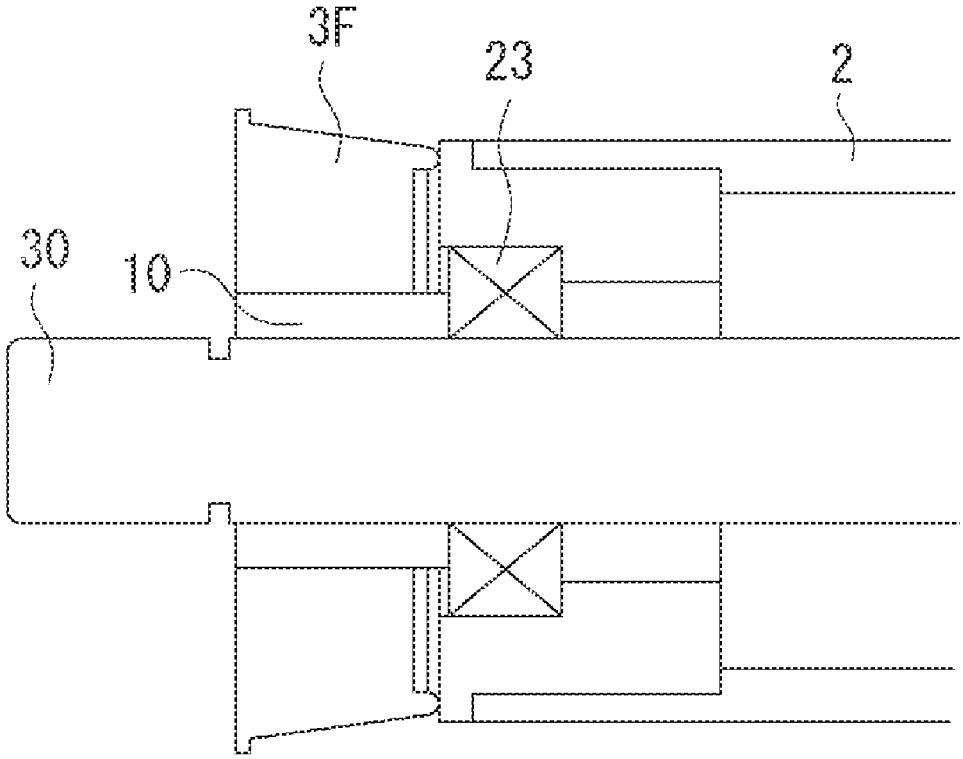
FIG. 9 is a sectional view of a steering roller having a one-way clutch.

The sliding ring portion 3F has a configuration as illustrated in FIG. 9. The sliding ring portion 3F and a one-way clutch 10 are integrally connected (through, for example, forcing-in). The one-way clutch 10 is provided on the inner side of the sliding ring portion. More specifically, it is provided on the inner side of the steering roller. The one-way clutch 10 is a movement unit which suppresses movement in the moving direction of the intermediate transfer belt 606, and which allows the sliding ring portion to rotate in a direction opposite to the moving direction of the intermediate transfer belt 606 when a load is generated in the sliding ring portions. This movement unit also functions as a restriction unit (restriction means) restricting the movement of the sliding ring portions. More specifically, the one-way clutch 10 has a mechanism in which rotation is restricted with respect to the steering roller shaft 30 in the direction in which the intermediate transfer belt 606 is moved by the driving roller 604 (the direction indicated by the arrow V in FIG. 1), and in which rotation is not restricted in the direction opposite to the moving direction of the intermediate transfer belt 606. The sliding ring portion 3R has a similar configuration. The one-way clutch 10 in the present exemplary embodiment is of a cylindrical configuration and provided with a plurality of rollers on the portion thereof coming into contact with the steering roller shaft 30. Due to the configuration in which the plurality of rollers are rotatable in only one direction, the function of a one-way clutch is provided.

Further, since the driven roller portion 2 is supported by the steering shaft 30 via a bearing 23, the driven roller portion 2 is capable of both normal and reverse rotation with respect to the steering shaft 30.

The end portion of the steering shaft 30 is machined into a D-shaped configuration. The D-shaped portion is supported by a slide bearing 4, so that it is prevented from rotating.

Due to the above configuration, when, as illustrated in FIG. 8, when there occurs a change $D_F$ in the position of the point on the sliding ring portion 3F, which has been in contact with the intermediate transfer belt 606 as a result of the steering operation, the sliding ring portion 3F is also driven to rotate, so that it is possible to reduce the resistance force of the steering operation. More specifically, the sliding ring portion 3F is rotated in the direction opposite to the moving direction of the intermediate transfer belt 606. Although in this example the intermediate transfer belt 606 deviates to the sliding ring portion 3F side, a similar effect is obtained in the case in which the intermediate transfer belt 606 deviates to the sliding ring portion 3R side. More specifically, when the steering operation is performed, one end side of the steering roller 1 makes the movement as illustrated in FIG. 8.

Figure 10A:
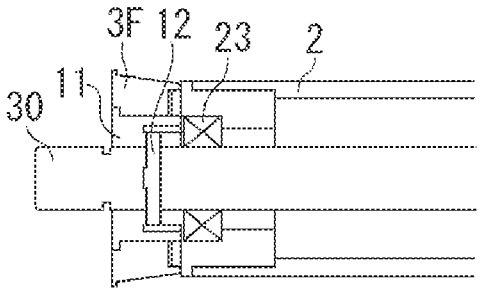
FIGS. 10A through 10C are a sectional view, a perspective view, and a partial view of a steering roller having a rotation restriction member, respectively.
Figure 10B:
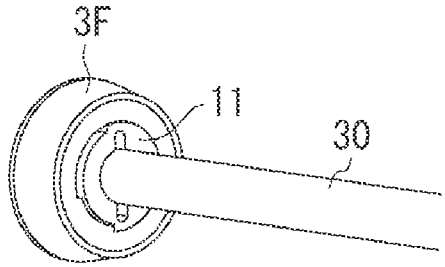
Figure 10C:
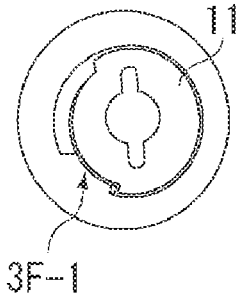

In the present exemplary embodiment, there is used a one-way clutch as a movement unit for allowing a position change of a point on the sliding ring portion 3F or 3R, which has been in contact with the intermediate transfer belt 606 as a result of the steering operation. However, it is also possible to adopt a configuration providing a function similar to that of a one-way clutch, for example, a configuration as illustrated in FIGS. 10A through 10C. FIG. 10A is a sectional view of the steering roller 1 in the case in which a rotation restriction member 11 is used instead of a one-way clutch. FIG. 10B is a perspective view of the steering roller 1 with the driven roller 2 not being illustrated. FIG. 10C is a front view of the rotation restriction member 11. The sliding ring portion 3R has a similar configuration. The rotation restriction member 11 is integrally connected with the steering roller shaft 30 by a parallel pin 12, and exhibits a plurality of outer contour portions differing in diameter. The sliding ring portion 3F is slidably fit-engaged with at least one outer contour portion of the rotation restriction member 11, and has a plurality of inner contour portions differing in diameter. More specifically, due to the provision of a protrusion 3F-1, the sliding ring portion 3F can be rotated by a rotation amount less than one rotation preset in both directions of forward and reverse directions in the direction in which the intermediate transfer belt 606 is moved.

In this configuration, during normal rotation of the intermediate transfer belt 606, the sliding ring portion receives a frictional force urging in the forward direction from the intermediate transfer belt 606, and the rotation restriction member 11 and the protrusion 3F-1 are in contact with each other. Thus, the sliding ring portion 3F cannot rotate in the moving direction of the intermediate transfer belt 606. When the steering roller 1 starts to be inclined, the sliding ring portion to which the belt does not deviate can be driven to move in the direction opposite to the moving direction of the intermediate transfer belt 606, so that it is possible to reduce the resistance force of the steering operation due to the frictional force.

In this way, in order that the sliding ring portion 3F may be restricted so as not to be capable of being driven to rotate in the conveying direction of the intermediate transfer belt 606, a step of a portion differing in inner diameter of the sliding ring portion 3F and a step of a portion differing in contour of the rotation restriction member 11 contact each other. Due to this configuration, it is possible to obtain the same effect as when a one-way clutch is used.

Also in this configuration, the end portion of the steering shaft 30 is formed as a D-shaped portion, and this D-shaped portion is supported by the slide bearing 4, so that it is prevented from rotating.

Figure 11:
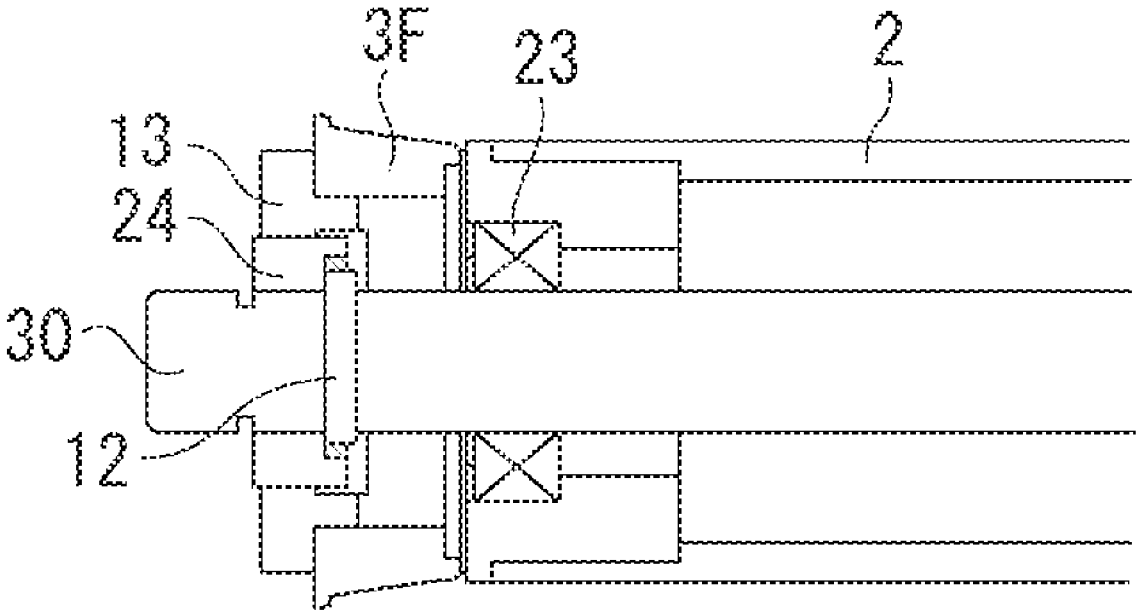
FIG. 11 is a sectional view of a steering roller having a torque limiter.

Further, as the movement unit based on a position change of a point on the sliding ring portion 3F or 3R, which has been in contact with the intermediate transfer belt 606 as a result of the steering operation, it is possible to adopt, for example, a configuration having a torque limiter as illustrated in FIG. 11. In FIG. 11, a torque limiter 13 is arranged so as to be incapable of rotating with respect to the steering roller shaft 30, and the sliding ring portion 3F is arranged with respect to the torque limiter 13 via a support portion 24 supporting the torque limiter 13. The sliding ring portion 3R has a similar configuration. In the state in which the steering roller 1 does not rotate in the direction S, with the rotation torque due to the frictional force that the sliding ring portion 3F receives from the intermediate transfer belt 606 moving in the direction V in FIG. 1, the sliding ring portion 3F is restricted in its rotation by the torque limiter 13. More specifically, the rotation of the sliding ring portion 3F in the same direction as the intermediate transfer belt 606 is restricted. Due to an increase in the frictional force caused by the position change of the point on the sliding ring portion 3F or 3R, which has been in contact with the intermediate transfer belt 606 as a result of the steering operation, the rotational torque increases. When a rotational torque of not less than a predetermined level is attained, the sliding ring portion 3F or 3R rotates in a direction opposite to the moving direction of the intermediate transfer belt 606, and the resistance force with respect to the steering operation is reduced. Further, from equation (1) discussed in relation to the description of the related art, the frictional force F that the sliding ring portion receives in the state in which the steering roller 1 does not rotate in the direction S is obtained as follows by using the belt overlapping width w:

$$F = w\int_0^{\theta_s} \mu_s T d\theta \tag{7}$$

The rotational torque τ that the sliding ring portion receives is obtained as follows by using the diameter r of the sliding ring portion:

$$\tau = rw\int_0^{\theta_s} \mu_s T d\theta \tag{8}$$

In the present exemplary embodiment, r=12.5 mm, $\theta_s$=150°, T=5300 gf, $\mu_s$=0.1, and w=4 mm. As a result, in the state in which the steering roller 1 does not rotate in the direction S, the rotational torque that the sliding ring portions 3F and 3R receive is 483.3 gf·cm, and this rotational torque value is adopted as the torque limiter selection reference.

The configuration of the driven roller portion 2 with respect to the steering shaft 30, and the configuration of the steering shaft 30 are similar to those described above.

In this way, also in a configuration in which a torque limiter is provided, it is possible to obtain a similar effect.

In the present exemplary embodiment, the material of the intermediate transfer belt 606 is not restricted to polyimide. It is also possible to adopt some other resin material or a metal material so long as it helps to form a belt whose basic layer is made of a material having an equivalent tensile modulus and hard to expand. Further, when the influence of the rotation of the steering roller 1 on the primary transfer portion and the secondary transfer portion is a permissible one, a primary transfer roller 607 and a secondary transfer roller 603 may also serve as an upstream suspension roller and a downstream suspension roller.

Figure 12:
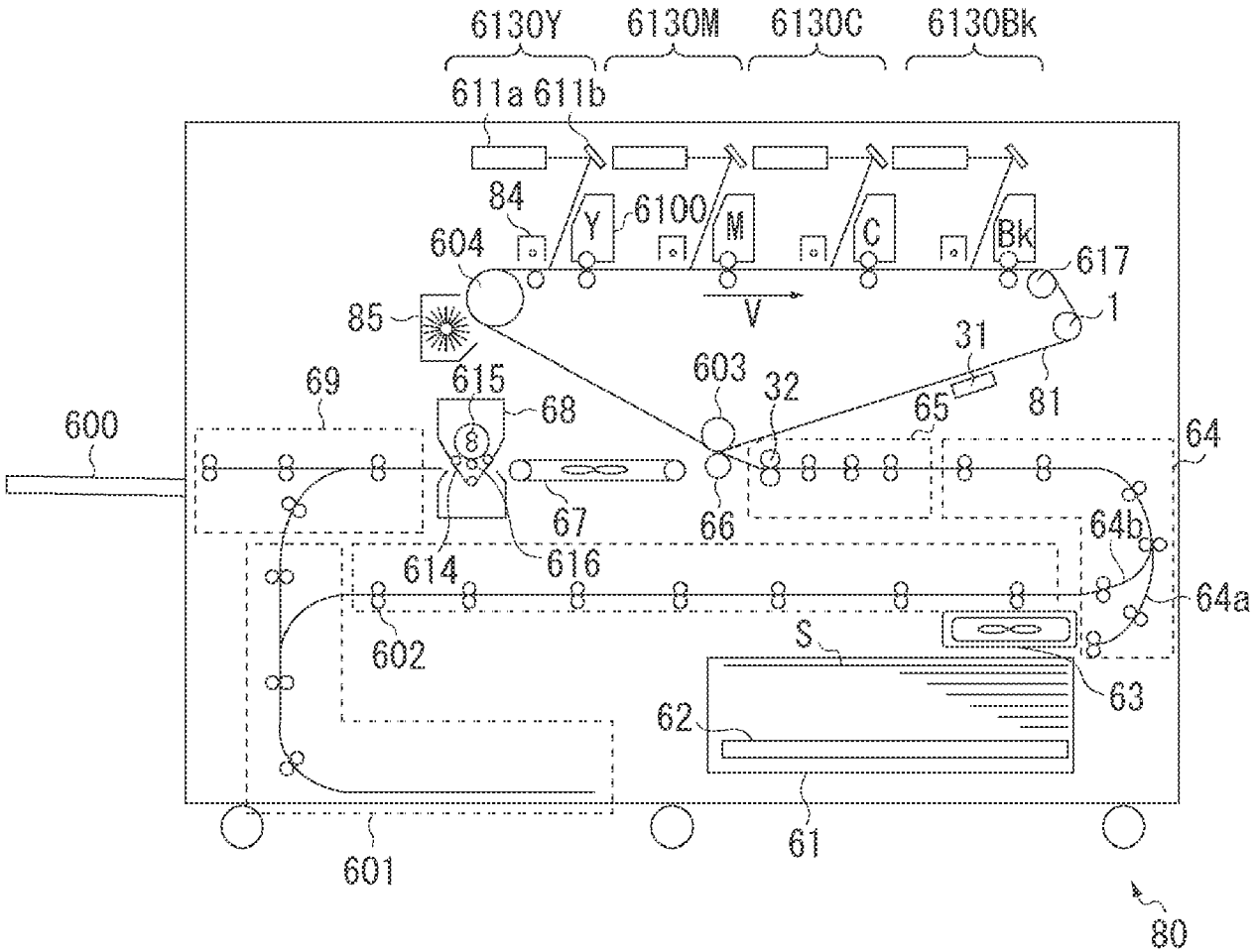
FIG. 12 is a sectional view of a photosensitive member belt type image forming apparatus according to a second exemplary embodiment of the present invention.

While in the first exemplary embodiment of the present invention the intermediate transfer belt is used as the belt member, in the second exemplary embodiment of the present invention, an image forming apparatus 80 as illustrated in FIG. 12 is equipped with a photosensitive member belt 81. The image forming apparatus 80 illustrated in FIG. 12 has a recording material feeding process and a recording material transport process, which are basically similar to those of the image forming apparatus illustrated in FIG. 2, so that, here, the image forming process, which differs from that of the first exemplary embodiment, will be described.

In the present exemplary embodiment, there are provided an image forming unit 6130Y performing development with yellow toner, an image forming unit 6130M performing development with magenta toner, an image forming unit 6130C performing development with cyan toner, and an image forming unit 6130Bk performing development with black toner. In the present exemplary embodiment, the image forming units are of the same configuration except that they differ in toner colors. Thus, as a typical example, the configuration of the image forming unit 6130Y will be described. The image forming unit 6130Y is mainly composed of a photosensitive member belt 81, a charging device 84, an exposure device 611*a*, a developing device 6100, etc. The components indicated by the same reference numerals as in the first exemplary embodiment are of the same configuration as those of the first exemplary embodiment.

The photosensitive member belt 81 is a belt member having a photosensitive layer on its surface and suspended by a driving roller 604, a steering roller 1, a transfer inner roller 603, and a driven suspension roller 617. The photosensitive member belt 81 is driven and conveyed in the direction of the arrow V in FIG. 12. The number of suspension rollers is not restricted to that of the configuration illustrated in FIG. 12. In this way, the surface of the photosensitive member belt 81 conveyed in the direction of the arrow V is uniformly charged by the charging device 84, and the surface is scanned by the exposure device 611*a*, so that an electrostatic latent image is formed on the photosensitive member belt 81. Here, the exposure device 611*a* is driven based on an input image information signal, and irradiates the photosensitive member belt 81 via a diffraction member 611*b*. The electrostatic latent image formed is developed with toner by the developing device 6100. A series of image forming processes is performed successively in the order of yellow (Y), which is the most upstream, magenta (M), cyan (C), and black (Bk), and are controlled in parallel and with a timing such that a toner image is superimposed on another upstream toner image. As a result, a full-color toner image is finally formed on the photosensitive member belt 81, and is conveyed to a transfer nip portion formed by the transfer inner roller 603 and a transfer outer roller 66. The process of transfer onto the recording material S, timing control, etc., at the transfer nip portion are basically similar to those of the intermediate transfer system described with reference to FIG. 2. The residual toner on the photosensitive member belt 81 is recovered by a belt cleaner 85, and the belt is made ready for the next image formation. While in FIG. 12 there are four image forming units 6130 for Y, M, C, and Bk, the number of colors and the order in which they are arranged are not restricted to those of this example.

Next, the unit configuration for the conveyance of the photosensitive member belt 81 will be described. The photosensitive member belt 81 is suspended by the driving roller 604, the steering roller 1, the transfer inner roller 603, and the driven suspension roller 617, and the belt member 81 is driven and conveyed in the direction of the arrow V in FIG. 12. Further, the steering roller 1 has also a tension roller function to directly impart a predetermined tension to the photosensitive member belt 81.

In the present exemplary embodiment, the automatic belt steering configuration described with reference to FIGS. 1, 4, 5A, and 5B is applied to the support configuration for the steering roller 1. The steering roller 1 has the tension roller function to impart a predetermined tension to the photosensitive member belt 81. The photosensitive member belt 81 is formed as a resin belt, a metal belt or the like, which has a relatively large tensile modulus and is hard to expand.

Figure 13:
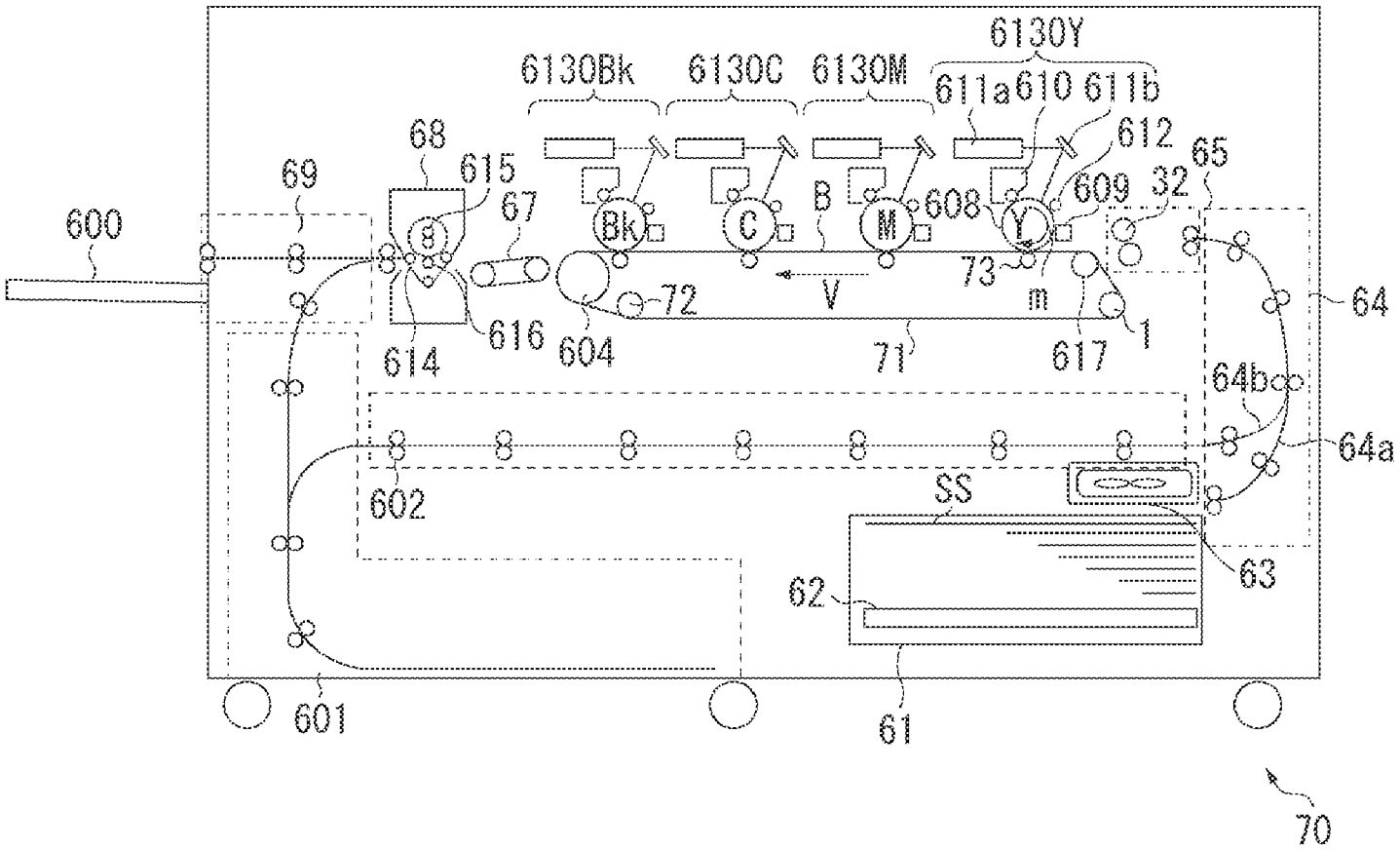
FIG. 13 is a direct transfer type image forming apparatus according to a third exemplary embodiment of the present invention.

Further, as a third exemplary embodiment of the present invention, a direct transfer member belt 71, which is a recording material transport belt member provided in an image forming apparatus 70 illustrated in FIG. 13, will be described by way of example. The image forming apparatus 70 illustrated in FIG. 13 has a recording material feeding process and a recording material transport process, which are basically similar to those of the image forming apparatus 60 illustrated in FIG. 2, so that the image forming process, which constitutes a difference, will be described.

In the present exemplary embodiment, there are provided an image forming unit 6130Y performing image formation with yellow (Y) toner, an image forming unit 6130M performing image formation with magenta (M) toner, an image forming unit 6130C performing image formation with cyan (C) toner, and an image forming unit 6130Bk performing image formation with black (Bk) toner. The image forming unit 6130Y, the image forming unit 6130M, the image forming unit 6130C, and the image forming unit 6130Bk are of the same configuration except that they differ in toner colors, so that the image forming unit 6130Y will be described as a representative. The image forming units 6130Y, 6130M, 6130C, and 6130Bk are of the same configuration as the image forming units described with reference to the first exemplary embodiment.

The image forming unit 6130Y is composed of a photosensitive member 608, which constitutes an image bearing member, a charger 612 charging the photosensitive member 608, an exposure device 611*a*, a developing device 610, a primary transfer device 607, and a photosensitive member cleaner 609. The surface of the photosensitive member 608, which rotates in the direction of the arrow m in FIG. 13, is uniformly charged by the charger 612. Based on an input image information signal, the exposure device 611*a* is driven, and the charged photosensitive member 608 is exposed via a diffraction member 611*b*. As a result of this exposure, an electrostatic latent image is formed on the photosensitive member 608. The electrostatic latent image formed on the photosensitive member 608 is developed by the developing device 610, so that a toner image is formed on the photosensitive member.

The recording material S, which is sent out by registration rollers 32 in synchronization with the yellow (Y) image forming process situated most upstream in the rotating direction of the transfer belt 71, is retained on an image formation suspension surface B of the transfer belt 71 by utilizing electrostatic attraction or the like. By a pressurizing force and an electrostatic load bias applied by the transfer device 73 to the recording material S borne and conveyed by the transfer belt 71, the toner image is transferred to the recording material S. Similar image formation processes and transfer processes are performed in parallel by the image forming unit 6130M, the image forming unit 6130C, and the image forming unit 6130Bk, which are situated on the downstream side of the image forming unit 6130Y with respect to the rotating direction of the transfer belt 71. Then, control is effected with a timing such that a downstream toner image is successively superimposed on another toner image on the recording material S conveyed by the transfer belt 71. As a result, a full-color toner image is finally formed on the recording material S, and, after self stripping (and also charge elimination stripping as needed) at a driving roller unit 604, the recording material S is conveyed to a pre-fixing transport portion 67 and a fixing device 68 on the downstream side with respect to the direction in which the recording material is conveyed. The residual toner on the photosensitive member 608 is recovered by the photosensitive member cleaner 609, and the photosensitive member 608 is made ready for the next image formation. While in FIG. 13 there are four image forming units 6130 for Y, M, C, and Bk, the number of colors and the order in which they are arranged are not restricted to the above ones.

Next, the configuration of the direct transfer belt unit, which is the conveyance unit for the transfer belt 71, will be described. The transfer belt 71 is an endless belt which is suspended by the driving roller 604, the steering roller 1, the upstream suspension roller 72, and the downstream suspension roller 617, and is driven and conveyed in the direction of the arrow V in FIG. 13. The number of suspension rollers is not restricted to that of the configuration illustrated in FIG. 13. In the present exemplary embodiment, the automatic belt steering configuration described with reference to FIGS. 4, 5A, and 5B is applied to the support configuration for the steering roller 1, and the steering roller 1 has also a tension roller function to impart a predetermined tension to the direct transfer belt 71. The transfer belt 71 is formed of a resin such as polyimide, which exhibits a relatively large tensile modulus and is hard to expand.

Figure 14:
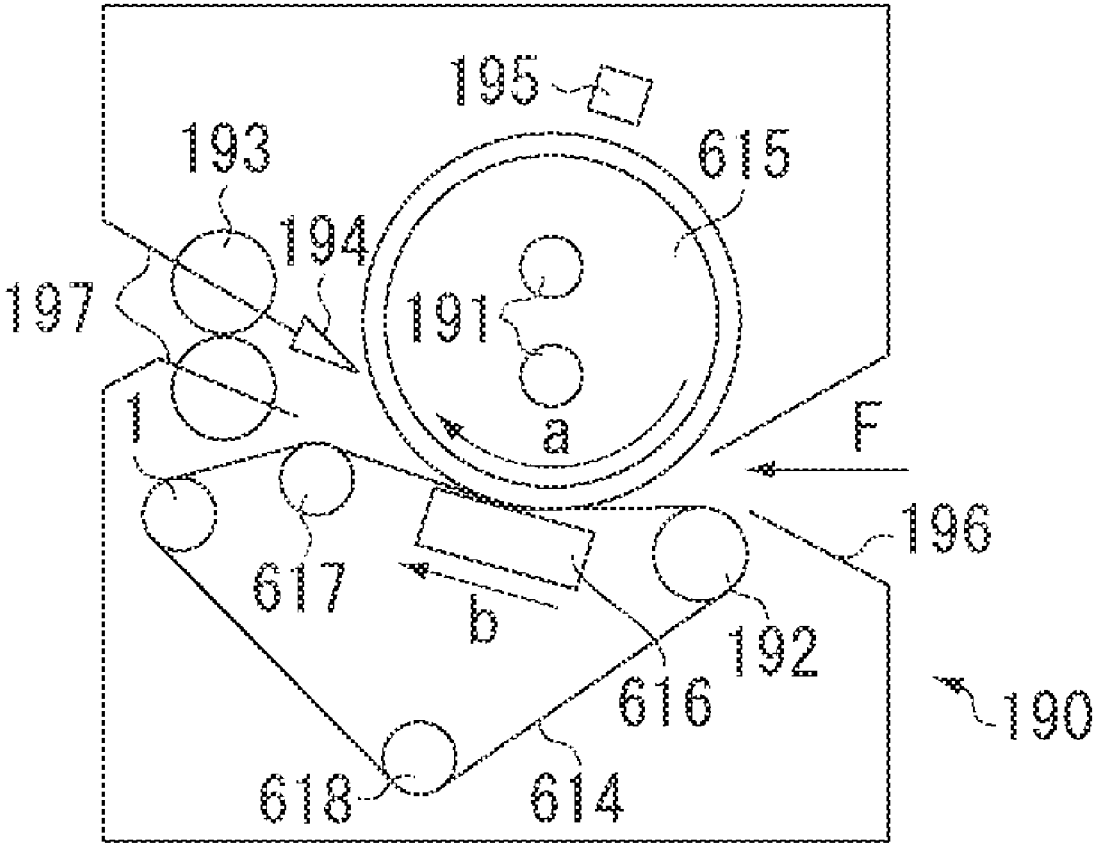
FIG. 14 is a sectional view illustrating how a belt is suspended according to a fourth exemplary embodiment of the present invention.

As a fourth exemplary embodiment of the present invention, a mode in which the present invention is applied to an endless belt driving device not related to image formation will be described, taking the fixing belt of a fixing device as an example of such a belt member. As already described with reference to FIG. 2, an image forming apparatus is equipped with a fixing device melting an unfixed toner image and causing it to adhere to the transfer material S by a pressurization/heating effect. While there are fixing devices of various types and configurations, the fixing device of the present exemplary embodiment adopts, as illustrated in FIG. 14, a belt system in which a nip is formed by a fixing roller 615 and a fixing belt 614, which are opposed to each other. As compared with the nip forming system using two fixing rollers opposite each other, the belt system can secure a nip region wider by an amount corresponding to the wrapping effect of the fixing belt 614. Thus, it is possible to increase the amount of heat imparted to the transfer material S, so that the system is effective in achieving an improvement in terms of image quality in the case of thick paper, coated paper, or the like, and an increase in the speed of the image forming apparatus.

The configuration of a fixing device 190 according to the present exemplary embodiment will be described with reference to FIG. 14. The fixing device 190 has a hollow fixing roller 615 containing a heater 191 constituting a heat generation member. The electricity supply to the heater 191 is controlled by a control unit (CPU) such that the temperature of the fixing roller 615 is set to a preset temperature by using a non-contact thermistor 195 or the like constituting a temperature detection member. The fixing roller 615 has a layer structure in which the front surface layer of a hollow core portion is coated with rubber, and is driven in the direction of the arrow "a" by a drive source (not shown). The pressurization belt 614 located opposite the fixing roller 615 is a belt member suspended by a driving roller 192, a steering roller 1, an upstream suspension roller 617, and a downstream suspension roller 618, and is driven and conveyed in the direction of the arrow "b". Here, the fixing roller 615 forms a wrapping angle in a form like that of an outer wrapping roller with respect to the pressurization belt 614, and back-up is effected with a predetermined pressure from the back side of the pressurization belt 614 by a pressurization pad 616 constituting a pressurization member, thereby securing a wide nip region. The recording material S, which has been conveyed in the direction of the arrow F in FIG. 14, is held/conveyed by the nip region from a fixing inlet guide 196. Then, while being aided by a separation claw 194, the recording material S undergoes self stripping from the nip region. Then, the recording material S is delivered to a downstream transport process of the image forming apparatus by a fixing discharge guide 197 and a fixing discharge roller 193.

By applying the steering roller 1 described with reference to the first exemplary embodiment to this fixing device, it is possible to achieve a similar effect.

As described above, according to the exemplary embodiments of the present invention, it is possible to diminish the influence of a twisting force of a belt member generated through twisting of the belt member that is generated through inclination of a steering member, thus enabling the belt member to move more smoothly.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-195700 filed Aug. 26, 2009, which is hereby incorporated by reference herein in its entirety.

What is claimed is:

1. A belt driving device comprising:

a belt member configured to be rotatable;

a suspension unit configured to suspend the belt member;

a steering device configured to suspend the belt member and to steer the belt member, the steering device including a rotating portion configured to be driven to rotate as the belt member is rotated, friction portions provided on both outer sides of the rotating portion in a width direction of the belt member and held in sliding contact with the belt member, a support unit configured to support the rotating portion and the friction portions, and a rotation shaft configured to rotatably support the support unit, the support unit being rotated by a force generated through the sliding contact between the belt member and the friction portions, so that the steering device allows the belt member to move in the width direction; and a restriction unit provided in the steering device and configured to restrict rotation of the friction portions in a rotating direction of the belt member and to allow rotation of the friction portions in a direction opposite to the rotating direction.

2. The belt driving device according to claim 1, wherein the restriction unit is provided inside a steering roller formed by the friction portions and the rotating portion.

3. The belt driving device according to claim 1, wherein the restriction unit includes a one-way clutch configured to allow the friction portions to rotate in the opposite direction.

4. The belt driving device according to claim 1, wherein the restriction unit includes a limiter set to a torque such that the friction portions do not rotate in the same direction as the rotating direction when the belt member and the friction portions are in sliding contact with each other while the belt member is rotating in the rotating direction, and that the friction portions rotate in a direction opposite to the moving direction when steering is effected on the belt member through rotation of the steering member around the axis of the rotation shaft.

5. The belt driving device according to claim 1, wherein the belt member includes an intermediate transfer belt configured to bear a toner image to be transferred to a recording material.

6. The belt driving member according to claim 1, wherein the belt member includes a recording material conveying belt member configured to bear and convey a recording material.

7. An image forming apparatus comprising:

an image forming unit configured to form an image on a recording material; and the belt driving device according to claim 1.

8. A belt driving device comprising:

a belt member configured to be rotatable;

a suspension unit configured to suspend the belt member;

a steering device configured to suspend the belt member and to steer the belt member, the steering device including a rotating portion configured to be driven to rotate as the belt member is rotated, friction portions provided on both outer sides of the rotating portion in a width direction of the belt member and held in sliding contact with the belt member, a support unit configured to support the rotating portion and the friction portions, and a rotation shaft configured to rotatably support the support unit, the support unit being rotated by a force generated through the sliding contact between the belt member and the friction portions, so that the steering device allows the belt member to move in the width direction; and a restriction unit provided in the steering device and configured to restrict an amount by which the friction portions move in a rotating direction of the belt member and an amount by which the friction portions move in a direction opposite to the rotating direction.

9. The belt driving device according to claim 8, wherein the restriction unit includes a second rotating portion configured to rotate integrally with the friction portions, and a stopper configured to stop rotation of the second rotating portion, and wherein the second rotating portion is configured to contact the stopper to restrict the rotation of the friction portions.

10. The belt driving device according to claim 8, wherein the belt member includes an intermediate transfer belt configured to bear a toner image to be transferred to a recording material.

11. The belt driving member according to claim 8, wherein the belt member includes a recording material conveying belt member configured to bear and convey a recording material.

12. An image forming apparatus comprising:

an image forming unit configured to form an image on a recording material; and the belt driving device according to claim 8.

* * * * *